US005580267A

United States Patent [19]

Stipanuk et al.

[11] Patent Number: 5,580,267

[45] Date of Patent: Dec. 3, 1996

[54] ELECTRICAL CONNECTOR FOR A PRINTED CIRCUIT BOARD

[75] Inventors: John M. Stipanuk, Winfield; Kent E. Regnier, Lombard, both of Ill.

[73] Assignee: Molex Incorporated, Lisle, Ill.

[21] Appl. No.: 530,781

[22] Filed: Sep. 19, 1995

[51] Int. Cl.[6] ..... H01R 13/62

[52] U.S. Cl. ..... 439/326; 29/845; 439/630

[58] Field of Search ..... 439/326, 629, 439/630, 636, 637; 29/845

[56] References Cited

U.S. PATENT DOCUMENTS

| | | | |
|---|---|---|---|
| 4,722,700 | 2/1988 | Kuhn et al. | 439/629 |
| 4,725,250 | 2/1988 | Kuhn et al. | 439/629 |
| 4,957,448 | 9/1990 | Stanevich et al. | 439/326 |
| 4,973,270 | 11/1990 | Billman et al. | 439/630 |
| 5,009,611 | 4/1991 | Regnier | 439/326 |
| 5,026,297 | 6/1991 | Krehbiel | 439/326 |
| 5,061,201 | 10/1991 | Tuan | 439/326 |
| 5,071,371 | 12/1991 | Harwath et al. | 439/637 |
| 5,082,459 | 1/1992 | Billman et al. | 439/637 |
| 5,094,624 | 3/1992 | Bakke et al. | 439/326 |
| 5,100,337 | 3/1992 | Lee Chao | 439/326 |
| 5,147,214 | 9/1992 | Korsunsky et al. | 439/326 |
| 5,161,995 | 11/1992 | Bakke et al. | 439/326 |
| 5,162,002 | 11/1992 | Regnier | 439/637 |
| 5,259,793 | 11/1993 | Yamada et al. | 439/637 |
| 5,263,870 | 11/1993 | Billman et al. | 439/108 |

OTHER PUBLICATIONS

Pp. 26E, 29E, 30E of Molex Full Line Catalog, No. 920, 1992.

SIMM Assemblies With Single Barb Design Dated Jan. 29, 1994.

*Primary Examiner*—Khiem Nguyen
*Assistant Examiner*—Yong Kim
*Attorney, Agent, or Firm*—Charles S. Cohen

[57] ABSTRACT

A connector assembly is adapted for electrically connecting a printed circuit board with another electrical device, the circuit board having a mating edge with a generally linear array of contact pads along the edge on each opposite side of the board. An elongated dielectric housing has a cavity along its length for receiving the mating edge of the printed circuit board, and a plurality of narrow closely-spaced slots extending transversely of the cavity. Each slot is adapted for receiving a unitary thin contact member having a singular base portion traversing the cavity with opposed spring contact arms extending from the singular base portion into the slot, and with distal ends of the contact arms engageable with the contact pads on both opposite sides of the printed circuit board. A plurality of pairs of thin contact members are mountable on the housing to form a closely-spaced linear terminal array lengthwise of the cavity. One pair of the contact members is located in each slot in the housing. One contact member in each pair thereof has a spring contact arm extending from a base into the slot with a distal end engageable with a contact paid on one side of the printed circuit board.

22 Claims, 3 Drawing Sheets

ELECTRICAL CONNECTOR FOR A PRINTED CIRCUIT BOARD

FIELD OF THE INVENTION

This invention generally relates to the art of electrical connectors and, particularly, to an edge connector for a printed circuit board.

BACKGROUND OF THE INVENTION

Multi-circuit electrical connectors for a printed circuit board typically include a plurality of electrical contact members or terminals disposed within a unitary dielectric housing, normally a molded plastic housing in which the terminals are inserted following molding. In these connectors, the housing typically surrounds portions of the terminals adjacent the printed circuit board to provide rigid support for the terminals.

Telecommunications equipment, computers and other electrical apparatus often include arrays of interconnected circuit boards. Each circuit board is formed by a rigid planar substrate with a plurality of integrated circuit chips and/or other electronic circuitry disposed thereon. This circuitry is connected to conductive regions or contact pads along one edge of the planar substrate to enable engagement of these circuit boards with a connector mounted on another circuit board. In this context, the circuit board on which the connector is mounted typically is referred to as the mother board. The board inserted in the connector typically is referred to as a daughter board, an edge card, a circuit module or other known terminology such as a SIMM (single in-line memory module).

A typical prior art connector houses a plurality of electrically conductive terminals. Each terminal includes a board mounting portion, such as a solder tail, which is soldered or otherwise connected to circuitry on the mother board, and a mating portion for electrically contacting a specific conductive edge contact pad on the daughter board. The daughter board often is removed and replaced to alter the functions that can be performed by the electrical apparatus in which the connector is associated. Additionally, the daughter board may be removed if any of the many circuits thereon fail or to facilitate trouble-shooting elsewhere in the electrical apparatus.

Prior art edge connectors, broadly employ two types of terminal arrangement. In one arrangements, "unitary" terminals or contact members are closely spaced, side-by-side in a linear array running the length of the connector. The unitary terminals have two contact portions, usually in the form of spring contact arms, which engage contact pads on both opposite sides of the daughter board. This provides a redundant engagement to each of the two commoned contact pads, one on each side of the board. Other arrangements employ "split" terminals or contact members wherein two separate and distinct terminals are used instead of the unitary terminal. Each one of the split terminals has only one contact portion or spring contact arm for engaging a contact pad on only one side of the daughter board. This electrically isolates the contact pads on opposite sides of the board so that additional electronic components can be mounted thereon.

A problem with having two different types of terminal arrangements, as described immediately above, is that different housings normally are used for the different terminal arrangements. This significantly increases tooling costs. It would be highly desirable to provide "split" terminals which can be inserted into the same housing which accepts "unitary" terminals. For instance, there exists literally millions of dollars of tooling for connectors using unitary terminals which could be retained and used if constructed to accept split terminal arrangements. The present invention is directed to that end and to solving the problems discussed above.

SUMMARY OF THE INVENTION

An object, therefore, of the invention is to provide a connector assembly, such as a SIMM connector, for electrically connecting a printed circuit board, such as a daughter board, with another electrical device, such as a mother board. The daughter board has a mating edge with a generally linear array of contact pads along the edge on each opposite side of the board.

The connector assembly includes an elongated dielectric housing having a cavity along its length for receiving the mating edge of the printed circuit board. A plurality of narrow closely-spaced slots extend transversely of the cavity. Each slot is adapted for receiving a unitary thin contact member having a singular base portion traversing the cavity, with opposed spring contact arms extending from the singular base portion into the slot, and with distal ends of the contact arms engageable with the contact pads on both opposite sides of the printed circuit board.

The invention contemplates the provision of a plurality of pairs of thin contact members mountable on the housing to form a closely-spaced linear terminal array lengthwise of the housing cavity. The contact members are constructed such that one pair of contact members is located in each slot in the housing that accepts the unitary contact members. One contact member in each pair thereof has a single spring contact arm extending from a base into the slot, with a distal end of the arm engageable with a contact pad on only one side of the printed circuit board.

In addition, the housing includes a pair of mounting sockets for each slot, with one socket in each pair thereof being located on each opposite side of the cavity for receiving a pair of mounting posts projecting from the base portion of a respective one of the unitary contact members. The invention contemplates that each contact member in each of the pairs of thin contact members include a mounting post positionable in one of the mounting sockets of each pair thereof.

Another feature of the invention is that the mounting post of each contact member in each of the pairs of thin contact members includes a generally straight datum edge facing inwardly toward the housing cavity. The datum edge is engageable with a datum surface in the respective mounting socket of the housing. Each mounting post includes an interference edge facing outwardly away from the housing cavity and engageable with an interference surface in the respective mounting socket and adapted to bias the datum edge of the mounting post against the datum surface of the housing.

Still further, each contact member in each of the pairs of thin contact members includes a second mounting post projecting from the base of the contact member into biased engagement with a transversely inwardly facing wall of the respective slot to further bias the datum edge of the first mounting post against the datum surface of the housing. The second mounting post is located between the spring contact arm and the first mounting post of the respective contact member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 2:
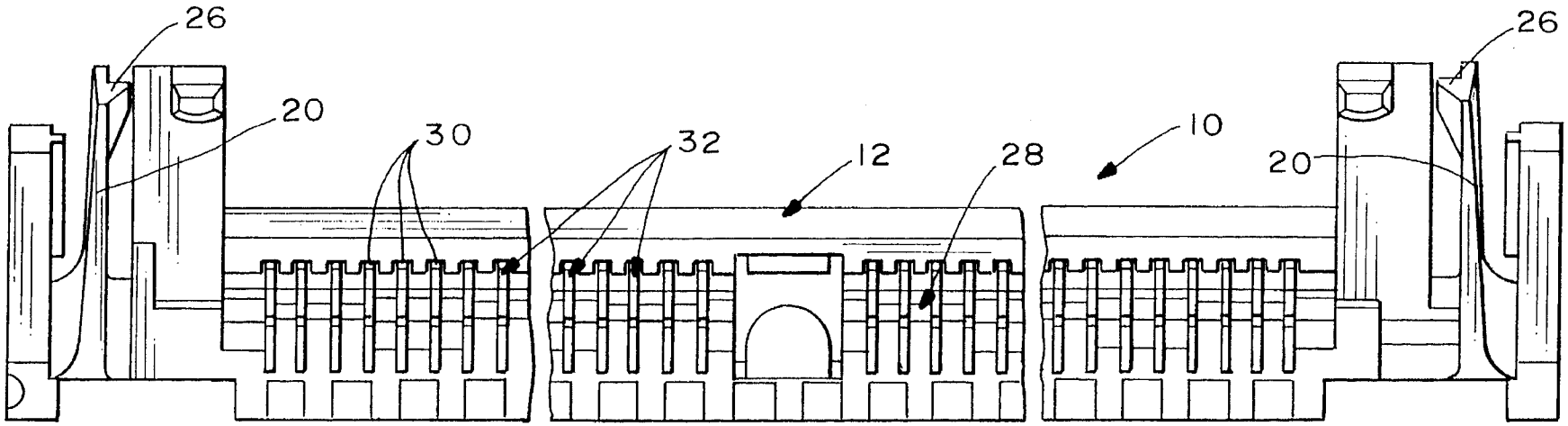
FIG. 2 is a top plan view of the connector.
Figure 1:
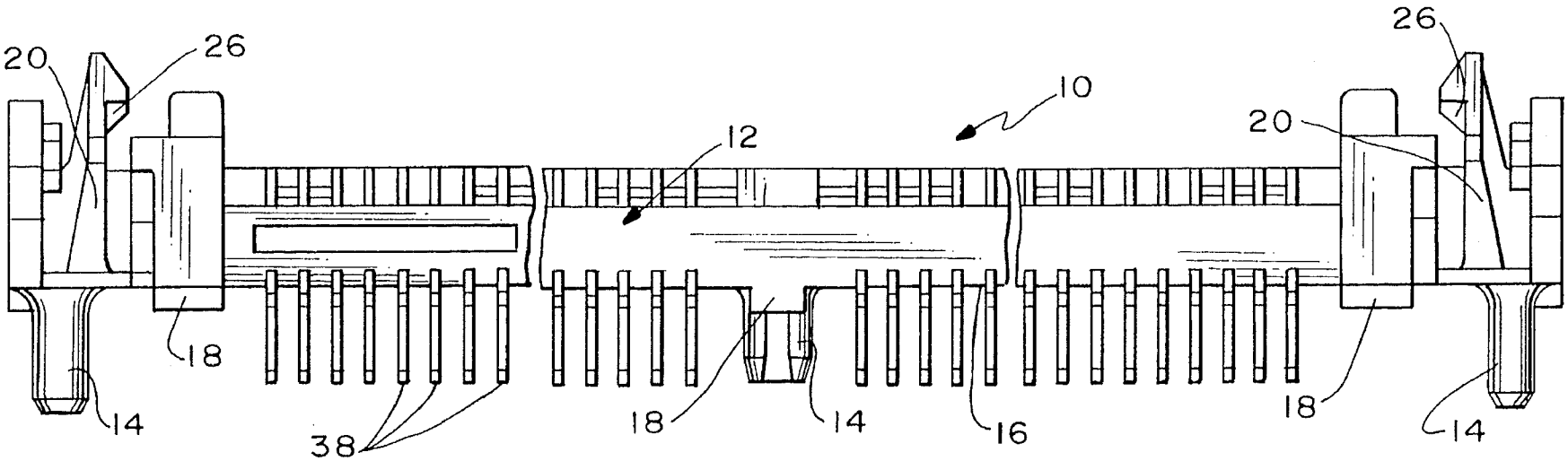
FIG. 1 is a front elevational view of an edge connector of the type embodying the concepts of the invention.

Referring to the drawings in greater detail, and first to FIGS. 1 and 2, a connector assembly, generally designated 10, is provided for electrically connecting closely-spaced circuit elements disposed on two printed circuit boards which are not shown in the drawings. Connector assembly 10 is shown as a SIMM connector which is adapted to be fixed to a mother board which is a high density printed circuit board including a plurality of closely-spaced circuit elements on at least one major surface thereof. The connector removably receives a second or daughter printed circuit board which includes a mating edge with a generally linear array of contact pads along the edge, usually on each opposite side of the board. The daughter board is inserted into the slot or cavity 28 in a first orientation relative to the housing with zero or minimal force between the contact pads and the contacts within the housing 12. The daughter board is then rotated relative to the housing to a second angular orientation which deflects the contact beams of the contacts. Further details of a similar connector arrangement are shown in U.S. Pat. No. 5,009,611 to Regnier, dated Apr. 23, 1991 and assigned to the assignee of this invention, which is incorporated herein by reference.

Suffice it to say, connector assembly 10 includes an elongated housing, generally designated 12, having a plurality of depending mounting bosses or posts 14 extending from a lower surface 16 of the housing and adapted to be received within appropriate mounting apertures in the mother board. Standoffs 18 also may depend from lower surface 16 to space housing 12 above the mother board. In addition, the housing has a pair of flexible latch arms 20 near opposite ends of the housing with latches 26 at the ends thereof for yieldably or removably retaining the daughter board in mated relationship with housing 12. In the alternative, the plastic latches could be replace with metal latches as is known in the art.

Figure 3:
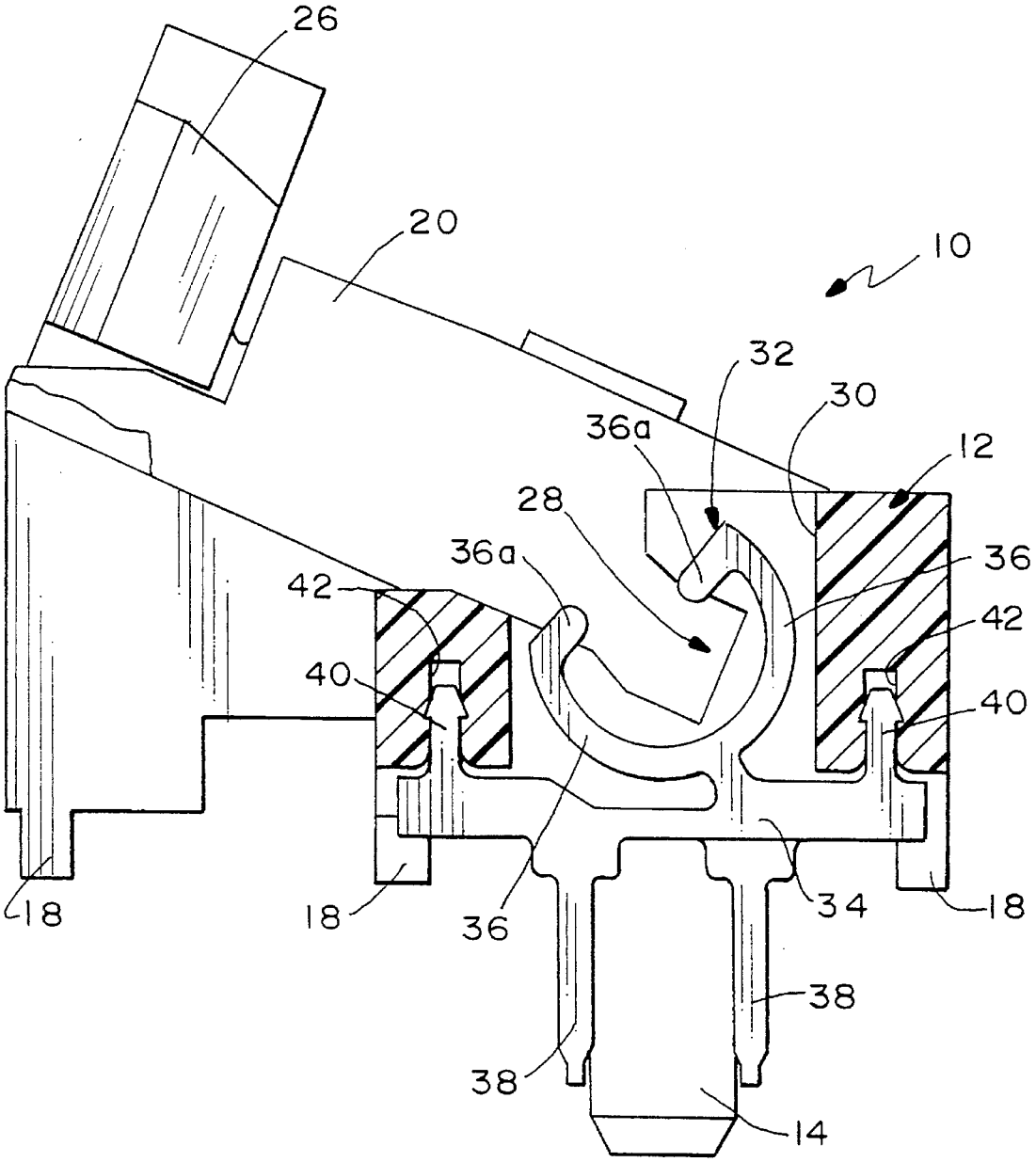
FIG. 3 is a transverse section through the connector, showing a "unitary" contact member mounted in one of the slots of the connector housing.

Referring to FIG. 3 in conjunction with FIGS. 1 and 2, housing 12 is a one-piece structure molded integrally of plastic material and includes a cavity, generally designated 28 (FIG. 3), along its length for receiving the mating edge of the daughter board. A plurality of closely-spaced compartments or narrow slots 30 are disposed along cavity 28, transversely of the cavity along the length of housing 12, for receiving a plurality of thin terminals or contact members, generally designated 32, to form a closely-spaced linear terminal array lengthwise of connector housing 12.

As best seen in FIG. 3, each contact member 32 is a unitary thin terminal having a singular base portion 34 traversing cavity 28 with opposed C-shaped spring contact arms 36 extending from the singular base portion into the respective slot 30. Distal ends **36*a* of spring contact arms 36 are engageable with contact pads on both opposite sides of the daughter printed circuit board. This provides a redundant engagement to each of the two commoned contact pads, one on each side of the board. A solder tail 38 depends from base portion 34 for insertion into an appropriate hole in the mother board, for solder connection to circuit traces on the board and/or in the hole. It can be seen in FIG. 3 that the solder tails are alternatingly staggered between adjacent contact members 32 transversely of cavity 28** lengthwise of the connector housing to form two longitudinal rows of solder tails along the length of the connector.

Each unitary contact member 32 is mounted to and rigidly supported on housing 12 by means of a pair of mounting posts 40 projecting upwardly of singular base portion 34 and into a pair of mounting sockets 42 molded in plastic housing 12. It can be seen in FIG. 3 that one mounting post and its corresponding mounting socket is located on each opposite side of the spring contact arms 36, i.e. on each opposite side of cavity 28. The contact members are stamped from sheet metal material, and it can be seen that each mounting post 40 has teeth on opposite edges thereof for skiving into the plastic material of housing 12 within mounting sockets 42 by an interference fit to seat the contact members onto the housing.

Figure 4:
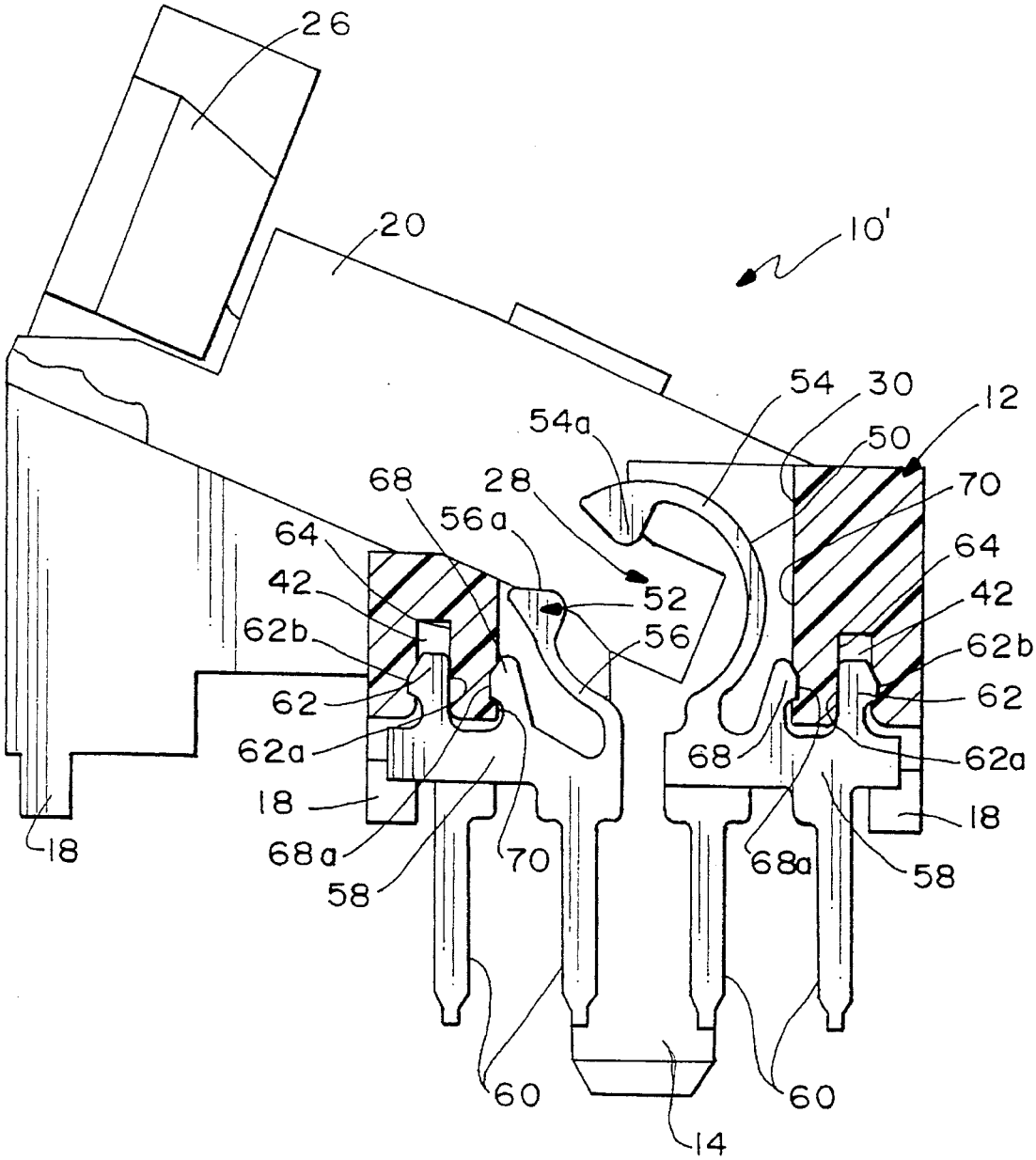
FIG. 4 is a view similar to that of FIG. 3, with a "split" pair of contact members mounted in the same slot as the unitary contact member of FIG. 3.

Referring to FIG. 4, connector housing 12 therein is substantially identical to the connector housing described above in relation to FIGS. 1–3, and corresponding reference numerals have been applied in FIG. 4 referring to like components in FIGS. 1–3. In particular, board-receiving cavity 28, terminal-receiving slots 30 and mounting sockets 42 are identical in FIG. 4 to that described above and shown in FIG. 3.

However, connector 10' in FIG. 4 includes a "split" contact or terminal arrangement which employs two distinct contact members, generally designated 50 and 52, in each singular slot 30 in housing 12. Again, contact members 50 and 52 are thin terminals stamped from sheet metal material. With this arrangement, a plurality of pairs of contact members 50 and 52 are mounted on housing 12 to form a closely-spaced linear terminal array lengthwise of cavity 28, with one pair of the contact members being located in each slot 30.

More particularly, each contact member 50 or 52 has a single spring contact arm 54 or 56, respectively, extending from a base 58 into the respective slot 30. The spring contact arms have distal ends **54*a* and 56*a* engageable respectively with a contact pad on only one side of the daughter board. This electrically isolates the contact pads on opposite sides of the board so that additional electronic components can be mounted thereon. Each contact member 50 or 52 has a single solder tail 60 depending from base 58. It can be seen that the solder tails of contact members 54 along one side of cavity 28 alternate between adjacent contact members in their relative positions transversely of housing 12. This defines two rows of solder tails 60 on the one side of cavity 28. The same alternating array of solder tails 60 is provided for contact members 52 on the opposite side of cavity 28. Therefore, four rows of solder tails are provided by contact members 50 and 52 lengthwise of housing 12, with two rows being located on each opposite side of cavity 28. In the alternative, rather than using through hole tails 60**, surface mount tails (not shown) could be utilized.

Mounting sockets 42 again are used for mounting contact members 50 and 52 on the housing. More particularly, each contact member 50 or 52 includes a first mounting post 62 projecting upwardly from the respective base 58 into one of the mounting sockets 42. Each mounting post 62 has an inner straight edge 62*a* facing cavity 28, and a toothed outer edge 62*b* facing away from the cavity. The straight edge 62*a* of the mounting post of each contact member defines a datum edge engageable with a flat datum surface 64 on the inside of the respective mounting socket 42. With this structural combination, toothed edge 62*b* of each contact member defines an interference edge facing outwardly away from cavity 28 for skiving into the plastic material of the housing and effectively biasing datum edge 62*a* against datum surface 64. This precisely positions each contact member in a transverse direction relative to housing 12 and the board-receiving cavity 28 which extends lengthwise of the housing.

Each contact member 50 or 52 includes a further or second mounting post 68 having an outwardly facing interference edge 68*a* for biasingly engaging a transversely inwardly facing wall 70 of the respective slot 30 to further bias datum edge 62*a* of mounting post 62 against datum surface 64 of the housing. Mounting posts 62 and 68 are effective to sandwich a portion of housing 12 therebetween.

From the foregoing, it can be seen that a singular housing 12 is constructed for receiving either a plurality of unitary contact members 32 (FIG. 3) in respective slots 30 longitudinally of the housing and lengthwise of board-receiving cavity 28. Yet the same housing receives "split" pairs of contact members 50 and 52, with one pair of contact members in each slot 30, without in any way changing or modifying the connector housing. This not only saves considerable money in inventory expenses, but millions of dollars of existing tooling for employing unitary contact members or terminals can be used with split terminal arrangements.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector assembly for electrically connecting a printed circuit board with another electrical device, the circuit board having a mating edge with a generally linear array of contact pads along the edge on each opposite side of the board, comprising:

an elongated dielectric housing having a cavity along its length for receiving the mating edge of said printed circuit board, and a plurality of narrow closely-spaced slots extending transversely of the cavity, each slot being adapted for receiving a first type of unitary thin contact member having a singular base portion traversing the cavity with opposed spring contact arms extending from the singular base portion into the slot with distal ends of the contact arms engageable with the contact pads on both opposite sides of the printed circuit board; and a plurality of pairs of a second type of split thin contact members mounted on the housing to form a closely-spaced linear terminal array lengthwise of the cavity, one pair of the second type of split contact members being located in each slot in the housing, and one contact member in each pair thereof having a single spring contact arm extending from a base for positioning into the slot with a distal end engageable with a contact pad on only one side of the printed circuit board.

2. The connector assembly of claim 1 wherein said housing includes a pair of mounting sockets for each slot with one socket in each pair thereof being located on each opposite side of said cavity adapted to receive a pair of mounting posts projecting from the base portion of a respective one of said first type of unitary contact members, and each contact member in each of said pairs of said second type of split thin contact members including a mounting post positioned in one of the mounting sockets of each pair thereof.

3. The connector assembly of claim 2 wherein the mounting post of each contact member in each of said pairs of the second type of split thin contact members includes a generally straight datum edge facing inwardly toward said cavity engaged with a datum surface in the respective mounting socket of the housing.

4. The connector assembly of claim 3 wherein the mounting post of each contact member in each of said pairs of the second type of split thin contact members includes an interference edge facing outwardly away from said cavity engaged with an interference surface in the respective mounting socket of the housing to bias said datum edge of the mounting post against the datum surface of the housing.

5. The connector assembly of claim 4 wherein said housing is fabricated of plastic material and said interference edge of the mounting post is adapted to skive into the plastic material of the housing within the mounting socket.

6. The connector assembly of claim 2 wherein each contact member in each of said pairs of the second type of split thin contact members includes a second mounting post projecting from the base of the contact member into biased engagement with a transversely inwardly facing wall of the respective slot to further bias said datum edge against the datum surface of the housing.

7. The connector assembly of claim 6 wherein said second mounting post is located between the spring contact arm and the first mounting post.

8. The connector assembly of claim 1 wherein each contact member in each of said pairs of the second type of split thin contact members includes at least one solder tail projecting from the bottom of the base of the respective contact member for insertion into an aperture in a second printed circuit board.

9. The connector assembly of claim 1 wherein each slot has an open bottom traversing the cavity for receiving the singular base portion which traverses the cavity.

10. A connector assembly for electrically connecting a printed circuit board with another electrical device, the circuit board having a mating edge with a generally linear array of contact pads along the edge on at least one side of the board, comprising:

an elongated dielectric housing having a cavity along its length for receiving the mating edge of said printed circuit board, and a plurality of narrow closely-spaced slots extending from a first side of said slot transversely of the cavity to a second side of said slot;

a plurality of contact members mounted on the housing in said slots to form a closely-spaced linear terminal array lengthwise of the cavity, each contact member including a base extending in a direction transversely of the cavity and a spring contact arm extending from the base into the respective slot with a distal end of each arm engageable with a contact pad on one side of the printed circuit board; and means for mounting each contact member in its respective slot in the housing, including a mounting post projecting from the base into a mounting socket in the housing on only said first side of said slot, the mounting post including a generally straight datum edge facing one side of said slot and engageable with a datum surface in the respective mounting socket of the housing, and each mounting post including an interference edge facing an other side of said slot and engageable with an interference surface in the respective mounting socket of the housing and being adapted to bias said datum edge against the datum surface.

11. The connector assembly of claim 10 wherein said housing is fabricated of plastic material and said interference edge of the mounting post is adapted to skive into the plastic material of the housing within the mounting socket.

12. The connector assembly of claim 10, including one of said contact members on each opposite side of the cavity within each slot.

13. The connector assembly of claim 10 wherein each contact member includes a second mounting post projecting from the base into biased engagement with a transversely inwardly facing wall of said first side of the respective slot to further bias the datum edge against the datum surface of the housing.

14. The connector assembly of claim 10 wherein the contact members are arranged in pairs with a first contact member in said first side of said slot and a second contact member on said second side of said slot and the contact arm on said first contact member supports the distal end of the contact arm at a point which is a greater vertical distance from the base than the point at which the contact arm on said second contact member supports the distal end.

15. A connector assembly for electrically connecting a printed circuit board with another electrical device, the circuit board having a mating edge with a generally linear array of contact pads along the edge on at least one side of the board, comprising:

an elongated dielectric housing having a cavity along its length for receiving the mating edge of said printed circuit board, and a plurality of narrow closely-spaced slots extending transversely of the cavity;

a plurality of contact members mounted on the housing in said slots to form a closely-spaced linear terminal array lengthwise of the cavity, each contact member including a base extending in a direction transversely of the cavity and a spring contact arm extending from the base into the respective slot with a distal end of each arm engageable with a contact pad on one side of the printed circuit board; and means for mounting each contact member on the housing including a pair of mounting posts projecting from the base transversely outwardly .of the spring contact arm, the pair of mounting posts sandwiching a portion of the housing therebetween and a first one of said pair of mounting posts projecting into a mounting socket of the housing.

16. The connector assembly of claim 15 wherein said first one of said pair of mounting posts has an interference edge which engages an interference surface in said mounting socket.

17. The connector assembly of claim 16 wherein a second one of the pair of mounting posts engages an inwardly facing wall of the housing within the respective slot.

18. The connector assembly of claim 15 wherein said first one of said pair of mounting posts projecting into said mounting socket has a generally straight datum edge which engages a generally straight datum surface in said mounting socket.

19. The connector assembly of claim 17 wherein said second one of said pair of mounting posts has an interference edge engaging said wall.

20. A connector assembly for electrically connecting a printed circuit board with another electrical device, the circuit board having a mating edge with a generally linear array of contact pads along the edge on each opposite side of the board, comprising:

an elongated dielectric housing having a cavity along its length for receiving the mating edge of said printed circuit board, and a plurality of narrow closely-spaced slots extending transversely of the cavity, each slot being adapted for receiving a pair of a first type of split thin contact members, one contact member in each pair thereof having a single spring contact arm extending from a base for positioning into the slot with a distal end engageable with a contact pad on only one side of the printed circuit board; and a plurality of a second type of unitary thin contact members mounted on the housing to form a closely-spaced linear terminal array lengthwise of the cavity, each of said second type of contact members having a singular base portion traversing the cavity with opposed spring contact arms extending from the singular base portion into the slot with distal ends of the contact arms engageable with the contact pads on both opposite sides of the printed circuit board.

21. The connector assembly of claim 19 wherein said housing includes a pair of mounting sockets for each slot with one socket in each pair thereof being located on each opposite side of said cavity adapted to receive a mounting post projecting from the base portion of a respective one of the pair of the first type of contact members, and each contact member in each of said pairs of said second type of thin contact members including a mounting post positioned in one of the mounting sockets of each pair thereof.

22. A method of fabricating a connector assembly for electrically connecting a printed circuit board with another electrical device, the circuit board having a mating edge with a generally linear array of contact pads along the edge on each opposite side of the board, said method comprising the steps of:

providing a common elongated dielectric housing having a cavity along its length for receiving the mating edge of said printed circuit board, and a plurality of narrow closely-spaced slots extending transversely of the cavity;

choosing from sets of contact members consisting of:

a first set of a plurality of a first type of unitary thin contact members mountable on the housing to form a closely-spaced linear terminal array lengthwise of the cavity, each of said first type of contact members having a singular base portion for traversing the cavity, with opposed spring contact arms extending from the singular base portion for location in a respective slot of the housing, and with distal ends of the contact arms engageable with the contact pads on both opposite sides of the printed circuit board, and a second set of a plurality of pairs of a second type of split thin contact members mountable on the housing to form a closely-spaced linear terminal array lengthwise of the cavity, with one pair of the second type of split contact members being positionable in each slot in the housing, and one contact member in each pair thereof having a single spring contact arm extending from a base for positioning into the slot with a distal end engageable with a contact pad on only one side of the printed circuit board; and mounting one of said first or second sets of contact members in the common housing.

* * * * *